US010371169B2

(12) United States Patent
Chebli et al.

(10) Patent No.: US 10,371,169 B2
(45) Date of Patent: Aug. 6, 2019

(54) NOISE REFLECTOR FOR A COMPRESSOR OF A TURBOMACHINE

(71) Applicant: Daimler AG, Stuttgart (DE)

(72) Inventors: Elias Chebli, Aidlingen (DE); Andreas Kliewer, Waiblingen (DE); Guillaume Heitz, Fellbach (DE); Simon Sauter, Stuttgart (DE); Derek Burny, Lake Orion, MI (US); Paul Loeffler, Stuttgart (DE); Helmut Traiser, Stuttgart (DE)

(73) Assignee: Daimler AG, Stuttgart (DE)

( * ) Notice: Subject to any disclaimer, the term of this patent is extended or adjusted under 35 U.S.C. 154(b) by 331 days.

(21) Appl. No.: 15/105,610

(22) PCT Filed: Sep. 30, 2014

(86) PCT No.: PCT/EP2014/002665
§ 371 (c)(1),
(2) Date: Jun. 17, 2016

(87) PCT Pub. No.: WO2015/090486
PCT Pub. Date: Jun. 25, 2015

(65) Prior Publication Data

US 2016/0312798 A1 Oct. 27, 2016

(30) Foreign Application Priority Data

Dec. 17, 2013 (DE) ..... 10 2013 021 191

(51) Int. Cl.
*F04D 29/66* (2006.01)
*F04D 29/42* (2006.01)
(Continued)

(52) U.S. Cl.
CPC ..... *F04D 29/663* (2013.01); *F02B 33/40* (2013.01); *F04D 29/4206* (2013.01);
(Continued)

(58) Field of Classification Search
CPC .... F04D 29/663; F04D 29/664; F04D 29/665; F04D 29/4213
See application file for complete search history.

(56) References Cited

U.S. PATENT DOCUMENTS 5,295,785 A * 3/1994 Church ..... F04D 29/4213 415/119
2012/0121400 A1* 5/2012 Tomita ..... F04D 29/4213 415/206

FOREIGN PATENT DOCUMENTS

DE 10 2009 019 754 A1 11/2010
DE 10 2010 021 929 A1 12/2011
(Continued)

OTHER PUBLICATIONS

DE 102011109704 Foreign Copy and Translated Copy.*
(Continued)

*Primary Examiner* — Woody A Lee, Jr.
*Assistant Examiner* — Aye S Htay
(74) *Attorney, Agent, or Firm* — Crowell & Moring LLP

(57) ABSTRACT

A noise reflector for a compressor of a turbomachine, in particular an exhaust gas turbocharger, is provided. The noise reflector includes at least one form-locking element with a direction of longitudinal extension, by way of which the noise reflector can be fastened to a housing part of the compressor such that a form-locking connection is produced, and the direction of longitudinal extension of the form-locking element goes in the axial direction.

4 Claims, 2 Drawing Sheets

(51) Int. Cl.

| | |
|---|---|
| ***F02B 33/40*** | (2006.01) |
| ***F04D 29/62*** | (2006.01) |
| *F04D 25/02* | (2006.01) |

(52) U.S. Cl.
CPC ..... *F04D 29/4213* (2013.01); *F04D 29/624* (2013.01); *F04D 29/665* (2013.01); *F04D 25/024* (2013.01); *F05D 2260/36* (2013.01)

(56) References Cited

FOREIGN PATENT DOCUMENTS

| | | | | |
|---|---|---|---|---|
| DE | 10 2011 109 704 | A1 | 2/2013 | |
| DE | 102011109704 | A1 * | 2/2013 | ..... F04D 25/024 |
| JP | 2012-215200 | A | 11/2012 | |

OTHER PUBLICATIONS

International Search Report (PCT/ISA/210) issued in PCT Application No. PCT/EP2014/002665 dated Jan. 23, 2015 with English-language translation (four (4) pages).
German-language Written Opinion (PCT/ISA/237) issued in PCT Application No. PCT/EP2014/002665 dated Jan. 23, 2015 (six (6) pages).
Japanese-language Office Action issued in counterpart Japanese Application No. 2016-540571 dated Apr. 25, 2017 with partial English translation (four (4) pages).
Japanese-language Office Action issued in counterpart Japanese Application No. 2016-540571 dated Sep. 19, 2017 with English translation (six (6) pages).

* cited by examiner

NOISE REFLECTOR FOR A COMPRESSOR OF A TURBOMACHINE

BACKGROUND AND SUMMARY OF THE INVENTION

The invention relates to a noise reflector for a compressor of a turbomachine, in particular an exhaust gas turbocharger.

Such noise reflector for a compressor of a turbomachine, in particular of an exhaust gas turbocharger of an internal combustion engine, is known from DE 10 2011 109 704 A1. The noise reflector is a conductive element in order to reduce noise of the compressor. The conductive element or the noise reflector is for example formed as noise ring and has at least one first length section extending at least substantially in the axial direction and at least one adjoining second length section extending inwards from the first length section in relation to the radial direction. The noise reflector also has at least one form-locking element by means of which the noise reflector can be fastened to a housing of the compressor in such a way that a form-locking connection is produced. The form-locking element is arranged in the first length section. The form-locking connection is a mechanical locking in the form of a snap-in connection by means of which the noise reflector is or can be fastened to the housing part.

The noise is reduced by the noise reflector in particular through reflection and interference of sound waves generated by a compressor wheel of the compressor. Due to the reflection and interference, the sound waves can only partly propagate in an inlet area of the compressor wheel.

It is the object of the present invention to further develop a noise reflector of the type stated above in such a way that an especially tight fastening of the noise reflector formed separately from the housing part can be realized on the housing part.

In order to further develop a noise reflector in such a way that an especially tight fastening of the noise reflector on the housing part can be realized, the invention provides that the direction of longitudinal extension of the form-locking element goes in the axial direction of the noise reflector and therewith the compressor. Due to this configuration of the form-locking element, an especially high axial pull-out force and a very high torsion resistance can be realized, so that the noise reflector is connected especially tight to the housing part via the form-locking connection and is consequently fastened especially tight on the housing part in the axial direction and secured against rotations relative to the housing part. In other words, an especially tight position securing of the noise reflector relative to the housing part can be realized through the form-locking element. By means of the form-locking element, an especially stable fit of the noise reflector on the housing part can be realized, while generating only low production and assembly costs at the same time. The fastening of the noise reflector on the housing part is especially simple.

The form-locking element is brought into interaction with a further form-locking element provided on the housing part in such a way that one of the form-locking elements engages the other form-locking element at least partly and forms the form-locking connection.

The form-locking connection creates a mechanical locking in particular in the form of a snap-in connection whose production is especially simple and therewith quick and inexpensive. The noise reflector is, for example, easily inserted into the housing part in the axial direction until the two form-locking elements are in mutual operative connection, i.e., interact.

Advantageously, it is provided that the form-locking element of the noise reflector has a convex shape, i.e., is outwardly curved and can be brought into interaction with a corresponding concavely shaped recess of the housing part, thereby forming the form-locking connection. In other words, the further form-locking element provided on the housing part is formed as a concavely shaped recess which can be engaged by the form-locking element provided on the noise reflector at least in part. Thus, a simple and quick and inexpensive mechanical locking in the form of a snap-in connection can be realized, by means of which the noise reflector can be fastened on the housing part in an especially tight way.

Further, an especially high radial tension of the noise reflector can be realized, so that the danger of the noise reflector disconnecting from the housing part due to heat influence and vibrations can be kept especially low. It is also possible to configure the form-locking connection free of play, at least substantially, so that relative noise of the noise reflector to the housing part and resulting noise such as rattling noise can be avoided.

The invention also includes a compressor of a turbomachine, in particular an exhaust gas turbocharger of an internal combustion engine, with a noise reflector in accordance with the invention. By means of the form-locking element, an especially tight form-locking connection between the noise reflector and the housing part of the compressor can be created, so that the danger of the noise reflector disconnecting from the housing part and moving in a suction distance of the internal combustion engine in an uncontrolled manner can be kept especially low.

Further advantages, features and details of the invention arise from the following description of a preferred exemplary embodiment and the drawing. The features and feature combinations stated in the description above as well as the features and feature combinations stated in the description of FIG. 1 hereinafter and/or shown in FIG. 1 cannot only be used in the respective stated combination but also in other combinations or alone without leaving the frame of the invention.

DETAILED DESCRIPTION OF THE DRAWING

Figure 1:
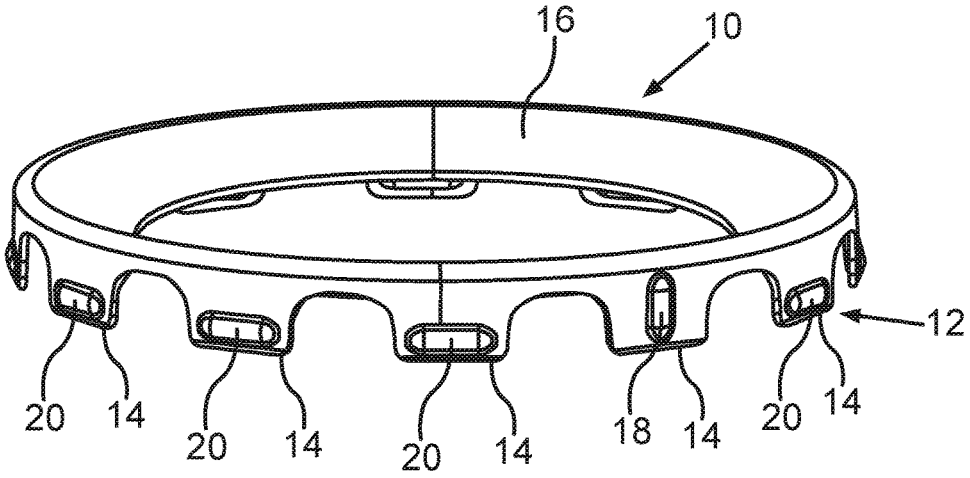
FIG. 1 is a schematic and perspective side view of a noise reflector for a compressor of a turbomachine in the form of an exhaust gas turbocharger of an internal combustion engine having at least one form-locking element with a direction of longitudinal extension by means of which the noise reflector can be fastened to a housing part of the compressor in such a way that a form-locking connection is produced, wherein the direction of longitudinal extension of the form-locking element goes in the axial direction of the noise reflector and therewith of the compressor.

FIG. 1 is a schematic and perspective side view of a noise reflector in the form of a noise ring 10 for a compressor of a turbomachine. The turbomachine is formed as an exhaust gas turbocharger of an internal combustion engine. The internal combustion engine formed as a reciprocating internal combustion engine serves to drive a vehicle, in particular a passenger vehicle.

The exhaust gas turbocharger not shown in FIG. 1 includes a turbine which is arranged in an exhaust tract through which the exhaust gas of the internal combustion engine can flow. The turbine includes a turbine housing as the first housing part in which a turbine wheel is arranged. The turbine wheel can be driven by the exhaust gas of the internal combustion engine and is connected to a shaft of the exhaust gas turbocharger in a torque-proof manner.

The compressor includes a compressor housing as the second housing part in which a compressor wheel is arranged. The compressor wheel serves to compress air and is also connected to the shaft in a torque-proof manner. Thus, the compressor wheel can be driven by the turbine wheel via the shaft, so that energy contained in the exhaust gas can be used for the compression of the air. The air is introduced into combustion chambers especially in the form of cylinders of the internal combustion engine so that an especially efficient operation of the internal combustion engine can be realized. In order to now reduce noises generated during the operation of the compressor or to keep them especially low, the compressor includes the noise ring 10 which is arranged in an inlet area of the compressor wheel. The noise ring 10 constitutes a conductive element for conducting or guiding the air flowing to the compressor wheel, wherein a defined and targeted guidance of the air by means of the noise ring 10 is realized in such a way that noise emissions are kept especially low.

The noise ring 10 has a first length section 12 with respective flaps 14. In a condition wherein the noise ring 10 is fixed on the compressor housing, the first length section 12 extends at least substantially in the axial direction of the compressor, wherein the axial direction of the compressor coincides with the axial direction of the noise ring 10. The noise ring 10 further includes at least one second length section 16 adjoining the first length section 12 and extending inwards from the first length section 12 in relation to the radial direction.

The efficient noise reduction which can be realized by means of the noise ring 10 takes place in particular by reflection and interference of sound waves generated by the compressor wheel which thus can only partly propagate in the inlet area of the compressor wheel, especially in a flow channel through which the air can flow.

The noise ring 10 includes at least one form-locking element which can be seen in FIG. 1 as first form-locking element referenced with 18. The following description of the form-locking element can also readily be transferred to the other first form-locking elements. The form-locking element 18 has a direction of longitudinal extension which goes in the axial direction of the noise ring 10 and—in relation to the condition of the noise ring 10 fastened on the compressor housing—in the axial direction of the compressor. The form-locking element 18 is formed convexly or as a convex curvature and can be brought into interaction with a corresponding concavely shaped recess of the compressor housing, thereby forming a form-locking connection.

The first form-locking elements are distributed at least substantially evenly in the circumferential direction of the noise ring 10. As presently the first three form-locking elements are provided, they are spaced from each other in pairs by 120 degrees. Alternatively, it can be provided that the noise ring 10 has an even larger number of first form-locking elements which are preferably evenly distributed in the circumferential direction of the noise ring 10.

It is clear from FIG. 1 that the noise ring 10 further includes a plurality of further form-locking elements 20. The respective further form-locking element 20 has a further direction of longitudinal extension, wherein the further direction of longitudinal extension goes in the circumferential direction of the noise ring 10. Thus, the respective further direction of longitudinal extension with the respective first direction of longitudinal extension of the respective first form-locking element 18 includes an angle of at least substantially 90 degrees. In other words, the first form-locking elements are at least substantially arranged in such a way that they are 90 degrees offset to the further form-locking elements.

Also the further form-locking elements 20 are formed convexly or as convex curvatures and can be brought into interaction with a respective corresponding concavely shaped further recess of the compressor housing, thereby forming a respective further form-locking connection.

FIG. 1 illustrates that the first form-locking elements as well as the second form-locking elements 20 are arranged on the respective flaps 14 and therewith in the first length section 12.

The respective form-locking connection is configured as mechanical locking in the form of a snap-in connection, so that the noise ring 10 can be mounted on the compressor housing in an especially simple, quick and inexpensive way. The noise ring 10 is for example pushed into the compressor housing in the axial direction. The noise ring 10 is pushed into the compressor housing until the first form-locking elements 18 and the further form-locking elements 20 interact with the respective corresponding recesses in such a way that the form-locking elements provided on the noise ring 10 engage the corresponding recesses provided on the compressor housing at least partly.

Figure 2:
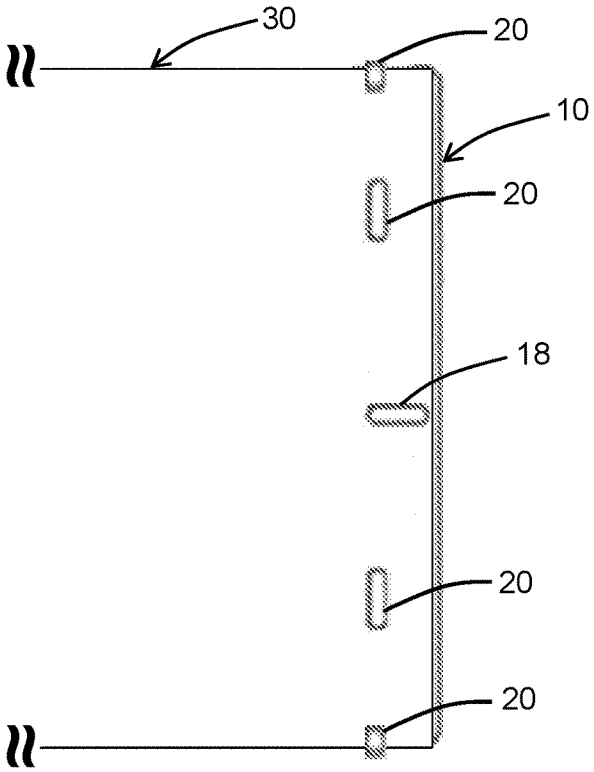
FIG. 2 is a schematic and side view of the noise reflector when it is fastened to the housing part of the compressor.

By means of the form-locking elements, an especially tight fastening of the noise ring 10 on the compressor housing 30 can be realized, so that the noise ring 10 has an especially stable fit on the compressor housing 30, as illustrated in FIG. 2. The first form-locking elements 18 thereby especially ensure a limitation or avoidance of a movement of the noise ring 10 relative to the compressor housing 30 in the circumferential direction, wherein the further form-locking elements 20 especially limit or avoid a movement of the noise ring 10 relative to the compressor housing 30 in the axial direction. In particular, a connection between the noise ring 10 and the compressor housing 30 which is at least substantially free of play can be realized by means of the form-locking elements 18, 20, so that relative movements and resulting rattling noise can be avoided.

Further, the danger of the noise ring 10 disconnecting from the compressor housing and moving in a suction tract of the internal combustion engine in an uncontrolled manner can be kept especially low. In particular, the first form-locking elements 18 provided in addition to the further form-locking elements 20 ensure an especially high radial tension and therewith a tight fastening of the noise ring 10 on the exhaust gas turbocharger so that a stable fit can be realized. Thus, the noise ring 10 can be kept on the compressor housing with an especially high mechanical strength and secured against a relative movement in the axial direction as well as in the circumferential direction.

LIST OF REFERENCE NUMBERS

10 noise ring
12 first length section
14 flap

16 second length section

18 first form-locking element

20 second form-locking element

The invention claimed is:

1. A noise reflector for a compressor of a turbomachine comprising:

at least one form-locking element with a direction of longitudinal extension, by way of which the noise reflector can be fastened to a housing part of the compressor such that a form-locking connection is produced, wherein the direction of longitudinal extension of the form-locking element goes in an axial direction of the noise reflector, the form-locking element has a longer length in the direction of longitudinal extension of the form-locking element than in a direction of circumferential extension of the form-locking element, the form-locking element has a convex shape and can be brought into interaction with a corresponding concavely shaped recess of the housing part when producing the form-locking connection, the noise reflector has at least one further form-locking element with a further direction of longitudinal extension, by way of which the noise reflector can be fastened to the housing part of the compressor such that a further form-locking connection is produced, the further direction of longitudinal extension of the further form-locking element going in a circumferential direction of the noise reflector, and the further form-locking element has a convex shape and can be brought into interaction with a corresponding concavely shaped further recess of the housing part when producing the further form-locking connection.

2. The noise reflector according to claim 1, wherein the turbomachine is an exhaust gas turbocharger.

3. A compressor for a turbomachine comprising a noise reflector according to claim 1.

4. The compressor according to claim 3, wherein the turbomachine is an exhaust gas turbocharger.

* * * * *